United States Patent [19]

Masuzawa et al.

[11] 4,279,030

[45] Jul. 14, 1981

[54] SPEECH-SYNTHESIZER TIMEPIECE

[75] Inventors: Sigeaki Masuzawa, Nara; Mituhiro Saizi, Kyoto, both of Japan

[73] Assignee: Sharp Kabushiki Kaisha, Osaka, Japan

[21] Appl. No.: 23,754

[22] Filed: Mar. 26, 1979

[30] Foreign Application Priority Data

Mar. 25, 1978 [JP] Japan ..... 53-34683

[51] Int. Cl.[3] ..... G04B 21/08; G04B 21/02

[52] U.S. Cl. ..... 368/63; 368/75

[58] Field of Search .... 58/14, 23 R; 38 R, 148–152 R, 58/13; 340/384 E; 368/63, 75, 250, 251, 272, 274

[56] References Cited

U.S. PATENT DOCUMENTS

| | | | |
|---|---|---|---|
| 3,813,533 | 5/1974 | Cone et al. | 58/152R |
| 3,998,045 | 12/1976 | Lester | 58/23 R |
| 3,999,050 | 12/1976 | Pitroda | 58/152 R |
| 4,055,843 | 10/1977 | Whitaker | 58/23 R X |

*Primary Examiner*—Vit W. Miska

*Attorney, Agent, or Firm*—Birch, Stewart, Kolasch & Birch

[57] ABSTRACT

A speech-synthesizer timepiece is adapted to produce audible sounds indicative of updated time information at a desired point in time through the use of the speech synthesizing technique. To avoid the user's failure to listen to the audible sounds or to avoid the user's error in dictating the audible sounds, an advance announcement is generated which includes a monotonous sound, a simple phrase or sentence. This advance announcement is provided when the audible sounds indicative of updated time is about to develop.

6 Claims, 5 Drawing Figures

SPEECH-SYNTHESIZER TIMEPIECE

BACKGROUND OF THE INVENTION

This invention relates to a speech-synthesizer timepiece, and more particularly to a speech-synthesizer timepiece capable of providing an audible announcement in advance of and immediately prior to the provision of audible sounds indicative of updated time.

A speech-synthesizer timepiece is well known, for example, U.S. Pat. No. 3,998,045 TALKING SOLID STATE TIMEPIECE by R. W. Lester. Such prior art was adapted to announce current time at preselected points in time by means of audible sounds. However, such prior art suffered from the disadvantages that the user might fail to listen or listen by mistake since audible sounds indicative of current time were provided without any advance announcement. For example, in the case where the audible sounds are automatically provided at an interval of one hour, the user may not be free of mistakes when listening to an audible indication of updated time unless electronic sounds such as onomatopoeic sounds ("peep peep") or words or phrases, such as "it" are provided in advance of the audible indication of updated time to attract the user's attention. Should the user fail to hear the leading sound (say, a consonant), the user would mistakenly misinterpret the audible sound indication. For example, with the audible indication of "five o'clock" ("goji" in Japanese), it is possible that the user may inadvertently hear only "oji" and thus misinterpret it to be "four o'clock" ("yoji" in Japanese).

It is therefore an object of the present invention to provide an improved sound-synthesizer timepiece which prevents the user's failure to hear and accurately interpret audible sounds or which prevents the user's error in dictating the audible sounds by providing advance announcement such as an audible phrase "it is now" or audible causation sounds, such as "peep peep".

For a more complete understanding of the present invention and for further objects and advantages thereof, reference is now made to the following description taken in conjunction with the accompanying drawings, in which:

FIGS. 4 and 5 are flow charts for illustration of operation of the embodiment shown in FIGS. 1 through 3.

DETAILED DESCRIPTION OF THE INVENTION

Figure 1:
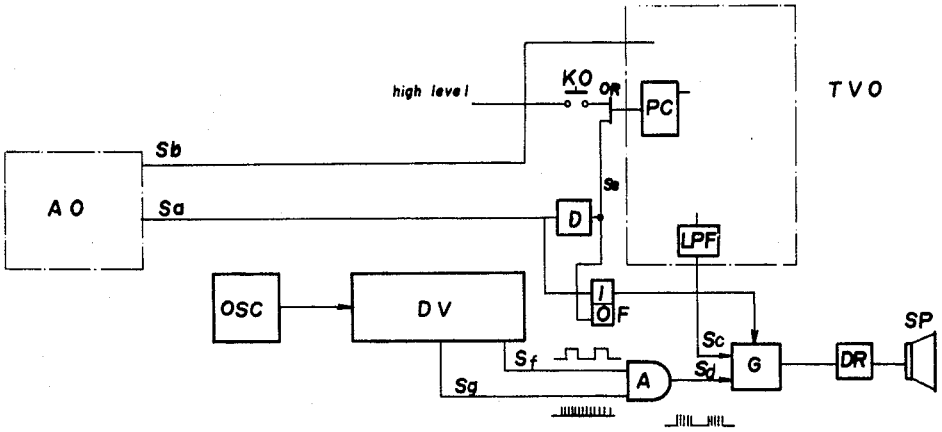
FIG. 1 is a schematic diagram of a speech-synthesizer timepiece according to one preferred embodiment of the present invention.

Referring now to FIG. 1, there is illustrated, in a schematic representation, a speech-synthesizer timepiece constructed according to one preferred embodiment of the present invention, which is adapted to automatically provide intermittent sounds for advance announcement immediately before an audible indication of updated time.

The illustrative embodiment includes an oscillator OSC for providing a frequency standard, a divider DV for dividing the output of the oscillator and providing different frequency signals Sf and Sg from the middle thereof, an AND logic gate F for producing an intermittent signal Sd based upon a logical sum of the signals Sf and Sg, a generator AO (described in detail later) for producing a signal Sa at a given interval within a limited time allocation and current time information Sb, a delay circuit D for delaying the signal Sa for a given period of time, a flip flop F provided to be set in response to the signal Sa and reset in response to the signal Se, a time announcing sound circuit TVO to be described with respect to FIG. 3, and a sequence control PC for developing commands in response to the signal Se or a keyed input via a time recall key Ko. The embodiment further comprises a low pass filter LPF, a gate circuit G responsive to the set or reset state of the flip flop F to select either an audio output Sc from the low pass filter or an intermittent sound signal Sd for supply to a speaker, Sp, and a driver DR for driving the speaker Sp for releasing the audible sounds indicative of updated time or the intermittent sound signal via the speaker Sp.

The output of the oscillator OSC is divided via the divider DV from the middle of which the two signals Sf, Sg are derived and then introduced into the AND logic gate A. The AND logic gate A provides the intermittent sound signal Sd for one input terminal of the gate circuit G. Upon the development of the signal Sa at the time signal generator AO the flip flip F is placed into the set state, enabling the gate circuit G to select the intermittent sound signal Sd, which actuates the driver DR to release the intermittent sounds from the speaker Sp.

Since the signal Sa from the circuit AO is also supplied to the delay circuit D, the delay circuit D will provide the signal Se after a predetermined period of time, placing the flip flop F into the reset state and enabling the gate circuit G to select the output signal Sc of the low pass filter LPF within the sound circuit TVO. Simultaneously, the sound circuit TVO provides the time information output signal Sc in response to signal Se. The driver DR is actuated by the signal Sc to provide audible sounds indicative of time information from the speaker Sp. Therefore, as long as the delay period is properly established by the delay circuit D, onomatopoeic sounds (for example, can be released in good time immediately before an audible indication of time information, for example, "peep peep", "five o'clock".

Although the audible sounds are provided automatically in the above illustrated embodiment, the audible sounds indicative of current time may be manually recalled by actuation of the key Ko. In this case the flip flop F is placed into the set state to enable the gate circuit G to select Sc from TVO so that the audible sounds are provided in the fashion of "—hour—minute" without any onomatopoeic sounds.

Figure 2:
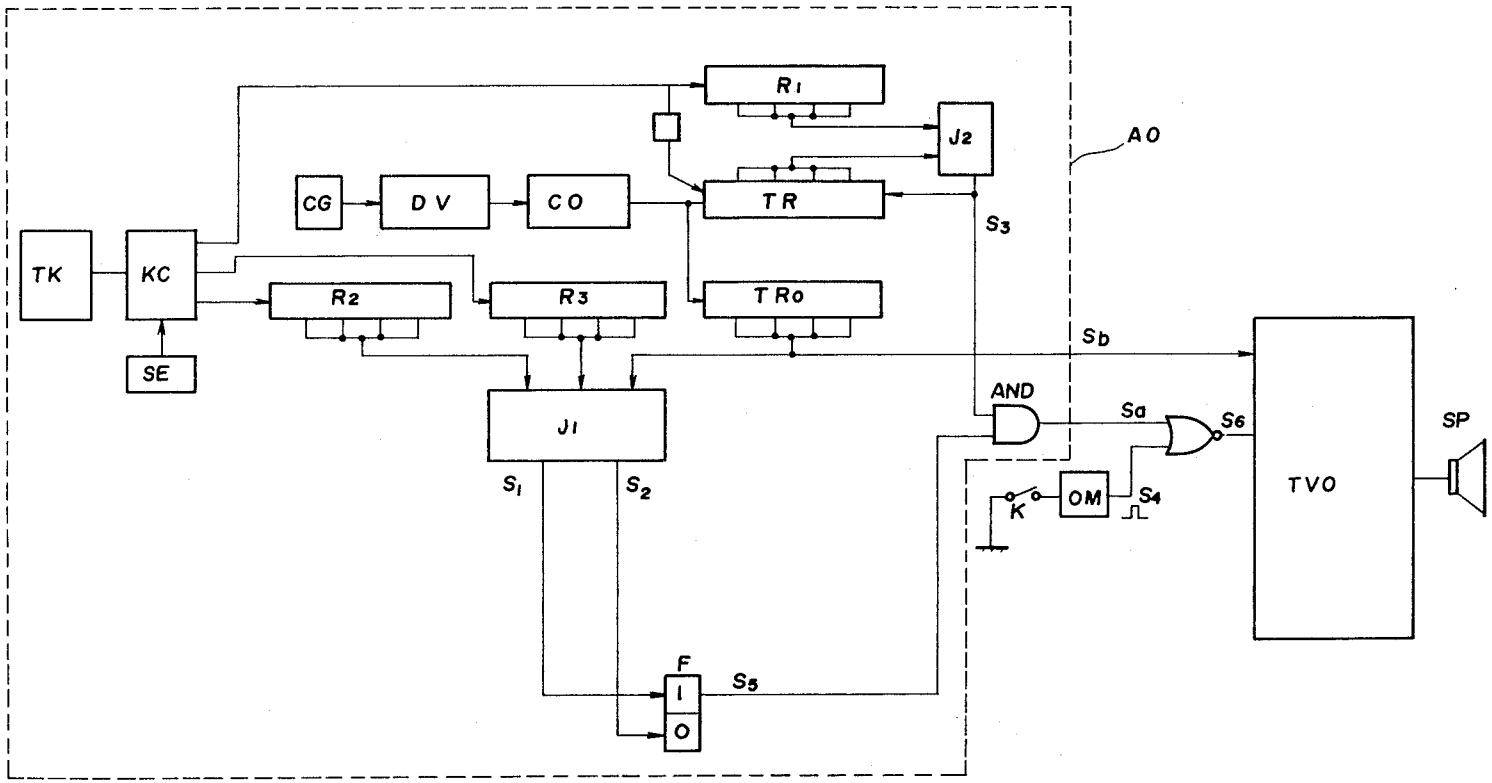
FIG. 2 is a block diagram of a time information output circuit in the embodiment of FIG. 1.

FIG. 2 shows details of an example of the time information generator AO of FIG. 1, which comprises an oscillator CG, a divider DV, a timekeeping counter CO for counting a 1 Hz signal from the divider DV, and a pair of registers TR, TRo for storing time information in the order of hours and minutes.

The register TR, TRo receives the output of the timekeeping counter CO, with the former being reset in response to the output of a judge circuit $J_2$ and the latter serving as a time register storing current time information.

A register $R_1$ stores an interval of time announcement (for example, at each hour), a register $R_2$ stores the beginning of a time zone of the day for time announcement (for example, 8:00 AM of a zone 8"00 AM through 10:00 PM) and a register $R_3$ stores the end of a time zone of the day for time announcement (in the given example, 10:00 PM).

A decision circuit $J_1$ detects coincidence between the registers $R_2$ and TRo or coincidence between the registers $R_3$ and TRo. The circuit $J_1$ provides a signal $S_1$ for the former and a signal $S_2$ for the latter. A decision circuit $J_2$ detects coincidence between the contents of the registers $R_1$ and TR and develops a signal $S_3$ to reset the register TR in the case of coincidence and hold a signal $S_6$ at the ground level.

The signal $S_5$ is the output of the flip flop F which is generated in the development of the output $S_1$ of the decision circuit $J_1$ and reset in response to $S_2$.

A keyboard TK includes digit keys for the entry of time information. A key control KC establishes the entry introduced via the keyboard TK in either of the registers $R_1$, $R_2$ or $R_3$. A change-over switch SE is adapted to select the output of the key control KC and hence select the register for storage of the key entry.

A one-shot pulse generator OM develops the signal $S_4$ upon actuation of the key K. A time voice alarm circuit TVO is responsive to a logical sum of the signals $S_3$ and the signal $S_4$ to develop audible signals indicative of the contents of the timekeeping register TRo.

The timepiece system constructed as above will operate in the following manner.

The switch SE is actuated so as to introduce the output signal of the key control KC only to the register $R_2$. Subsequently, the beginning of the time zone for the time announcement mode is entered via the keyboard TK and stored in the register $R_2$. The switch SE is then actuated to introduce the output signal of the key control KC only to the register $R_3$. In a similar manner, the end of the time zone for the time announcement mode is entered via the keyboard TK and introduced into the register $R_3$. Thus, the time zone for the time announcement mode is specified. For example, when it is desired to perform the time announcement mode from 8:00 AM to 6:00 PM, the keys are first actuated in the order of [8], [0] and [0] and then in the order of [1], [8], [0] and [0].

The interval for the time announcement mode is specified in the following manner. The switch is actuated to select the register $R_1$ for the entry of a desired interval for the time announcement mode. For example, when it is desired to execute the time announcement mode at each ten minutes, the digit keys [1] and [0] are sequentially actuated. The input signal to the register $R_1$ actuates the reset circuit RE to place the register TR into the reset state. For this purpose the signal $S_3$ is developed at each passage of the interval established within the register $R_1$.

Therefore, the timepiece receives all necessary items of information in this manner and is ready to perform the time announcement mode. In the given example, updated time is audibly indicated at the end of each ten minutes interval from 8:00 AM until 6:00 PM. In particular, when it is 8:00 AM, time information 8:00 is established within the register TRO and the decision circuit $J_1$ develops the coincidence output $S_1$ with $R_2$, setting the flip flop F to develop the signal $S_5$. The register $R_1$, on the other hand, stores the preselected period of ten minutes and places the register TR into the reset state at each lapse of ten minutes. The decision circuit $J_2$ develops the signal $S_3$ at each lapse of ten minutes, and thus satisfies a logical sum condition with the output signal $S_5$ of the flip flop F to make the signal $S_6$ effective. Such transition of the signal $S_6$ is sensed by the time voice announcement circuit TVO, enabling the contents of the register TRo to be audibly indicated. The register TR is reset concurrently with the development of the signal $S_3$ and the decision circuit $J_2$ senses non-coincidence and stops generating the signal $S_3$. Therefore, the signal $S_6$ is effective for only a moment. In other words, the impulsive signal $S_6$ is developed at every ten minutes.

Under the circumstances the contents of the register $R_3$ are exactly in agreement with the contents of the register TRo to thereby enable the decision circuit $J_1$ to develop the output $S_2$ to reset the flipflop F. Updated time information is audibly indicated upon the development of the signal $S_3$ only during the period where the signal $S_5$ is developed as one of input conditions of the AND logic gates.

In the given example, audible sounds "hachiji reifun (8:00)" are first provided and upon the passage of ten minutes "hachiji jyuppun (8:10)" are provided, followed by the audible indication of "hachiji nijyuppun (8:20)", "hachiji sanjyuppun (8:30)", and so forth.

Upon actuation of the key K, the one-shot circuit OM operates to develop the signal $S_4$ to enable the current time information at that time to be audibly provided. The contents of the registers $R_1$, $R_2$, $R_3$ may be selected at the option of the operator, for example, five minutes or one hour. Any desired time zone of the day may be also established.

When the signal $S_6$ is made effective, the announcement circuit TVO functions to provide an audible sound indicative of the contents of the register TRo.

Figure 3:
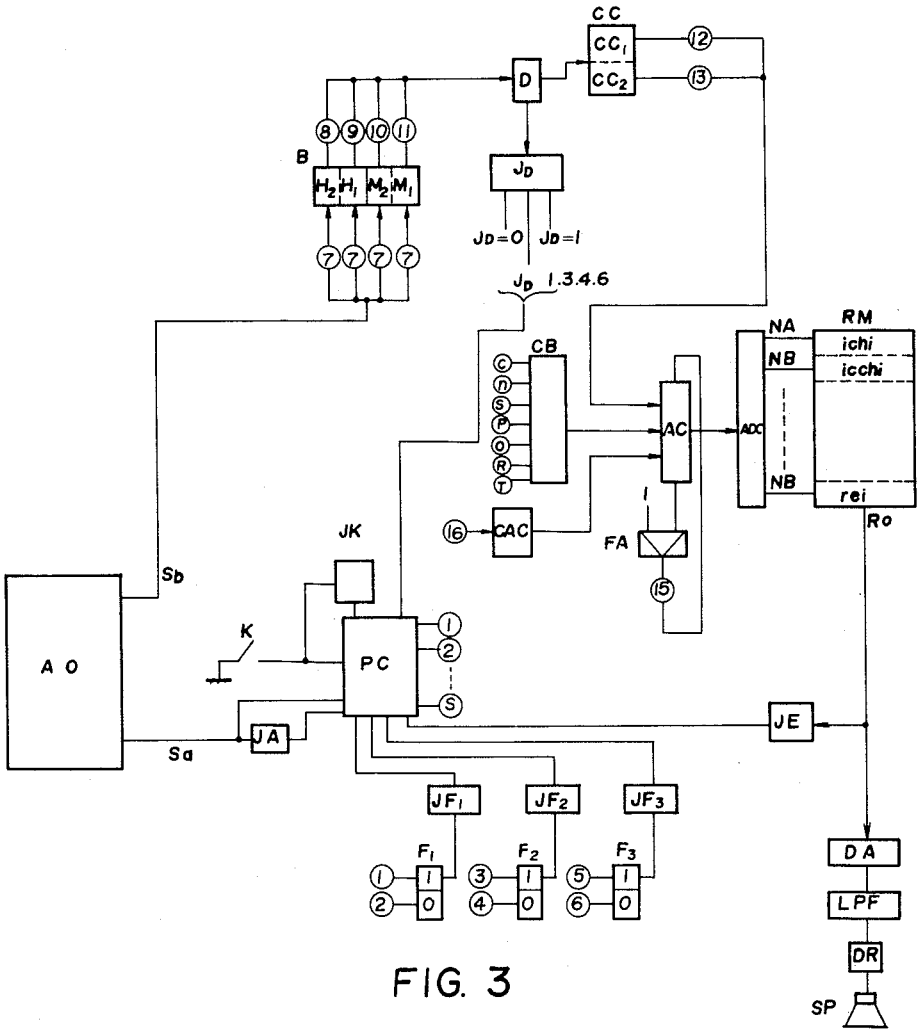
FIG. 3 is a block diagram of a sound producing circuit in the embodiment of FIG. 1.

FIG. 3 is a schematic block diagram of an example of the time announcement circuit TVO. The register B receives hour information and minute information from the register B, both of which are transferred into a one-digit buffer register D.

The read only memory RM contains sound quantizing data and thus voice elements as listed in Table 1.

TABLE 1

| | | | |
|---|---|---|---|
| NA | ichi | NK | hachi |
| NB | icchi | NL | ku |
| NC | ni | NM | kyuh |
| ND | san | NN | jyuh |
| NE | yo | NO | jyu |
| NF | yon | NP | ji |
| NG | go | NQ | pun |
| NH | roku | NR | fun |
| NI | rokku | NS | rei |
| NJ | nana | | |

In the foregoing Table 1, NA, NB, NC, . . . Nr, NS specify the initial addresses of the respective word elements, which are terminated with an END code. The output Ro of the read only memory RM is developed in a digital fashion and converted into a corresponding analog waveform compatible with voice outputs via a digital-to-analog converter DA and a low pass filter LPF, thereby enabling the speaker SP via the driver DR.

A first voice initial address decision circuit CC establishes the voice initial address according to the contents of the buffer register D for an audible indication of a desired voice, the address data being loaded into the address counter AC. A second voice initial address decision circuit CB specifies a command to be described later. More particularly, the voice word elements "it is now" are established within the BC circuit and loaded into the address counter AC. An adder FA effects addition of "1" on the contents of the address counter AC and thus increments the same. A reset circuit CAC resets the address counter AC and, when the address counter AC is not reset, the read only memory RM does not specify any address. In this manner, by specifying the voice initial address and incrementing the address counter AC, the respective ones of the word elements within the read only memory RM are selected in sequence via the address decoder ADC. The decision circuit $T_D$ connected to the buffer register D determines if the contents of the latter are "0" or "1" or "1, 3, 4, 6". The decision circuit $J_E$ senses the END code developed from the read only memory RM, RS type flip flops $F_1$–$F_2$ provide various controls and have decision circuits $JF_1$–$JF_3$ for their. The sequential control PC receives the signal $S_6$, and the various outputs of the decision circuits $J_D$, $J_E$, $J_{F1}$–$J_{F3}$, $J_K$, $J_A$ and provides commands ①, ②, . . . Ⓢ.

Figure 4:
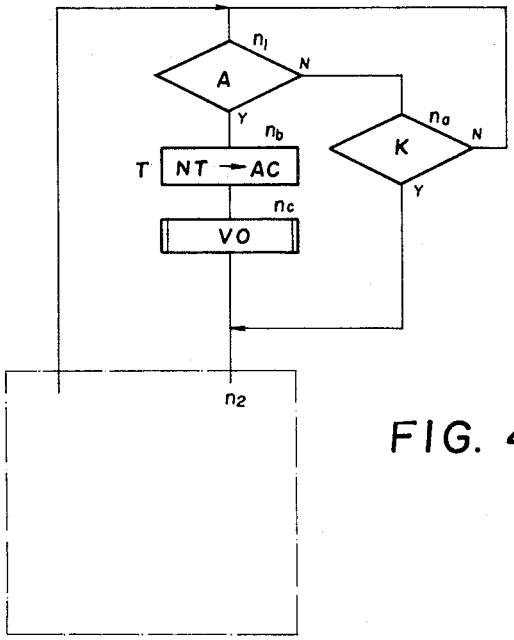

FIG. 4 depicts a flow chart for the development of the advance announcement and the time announcement. Upon actuation of the manual recall key $K_o$ the steps are carried out in the sequence of $n_1 \rightarrow n_a \rightarrow n_2$ for the audible sounds of "—hour—minute". In the case where the signal Sa is developed from the Ao circuit, the steps $n_1 \rightarrow n_6 \rightarrow n_c \rightarrow n_2$ are selected in sequence with the accompanying audible indication of "it is now" and "—hour—minute". Since details of these events are not of importance to the present invention, the disclose thereof is omitted. See, for example, our copending application Ser. No. 18,174 (our Ref. 1214-USA or GER).

Whereas the present invention has been described with respect to specific embodiments thereof, it will be understood that various changes and modifications will be suggested to one skilled in the art, and it is intended to encompass such changes and modifications as fall within the scope of the appended claims.

We claim:

1. A speech-synthesizer timepiece capable of providing an indication of updated time information, comprising;

audible sound warning signal generating means for developing an audible sound warning signal indicative of a forthcoming development of said indication of updated time information associated with said speech-synthesizer timepiece;

audible sound signal generating means for developing an audible sound signal representative of said indication of updated time information subsequent to the development of said audible sound warning signal by said audible sound warning signal generating means;

means responsive to said audible sound warning signal and to said audible sound signal for generating a first audible sound to provide a warning signal indicative of said forthcoming development of said indication of updated time information in accordance with said audible sound warning signal and for generating a second audible sound subsequent to the generation of said first audible sound and representing said indication of updated time information in accordance with said audible sound signal; and time interval counting means for providing a time count of the elapsed time within a predetermined time interval and for developing an output signal when said time interval counting means counts to the end of said predetermined time interval, said audible sound warning signal generating means developing said audible sound warning signal when the output signal from said time interval counting means is developed.

2. A speech-synthesizer timepiece capable of providing an indication of updated time information, comprising;

audible sound warning signal generating means for developing an audible sound warning signal indicative of a forthcoming development of said indication of updated time information associated with said speech-synthesizer timepiece;

audible sound signal generating means for developing an audible sound signal representative of said indication of updated time information subsequent to the development of said audible sound warning signal by said audible sound warning signal generating means;

means responsive to said audible sound warning signal and to said audible sound signal for generating a first audible sound to provide a warning signal indicative of said forthcoming development of said indication of updated time information in accordance with said audible sound warning signal and for generating a second audible sound subsequent to the generation of said first audible sound and representing said indication of updated time information in accordance with said audible sound signal;

time interval counting means for providing a time count of the elapsed time within a predetermined time interval and for developing an output signal when said time interval counting means counts to the end of said predetermined time interval, said audible sound warning signal generating means developing said audible sound warning signal when the output signal from said time interval counting means is developed; and time delay means responsive to said output signal from said time interval counting means for providing a time count of the elapsed time within a predetermined delay time period following the development of said output signal from said time interval counting means and for generating an output signal when said time delay means counts to the end of said delay time period, said audible sound signal generating means developing said audible sound signal when the output signal from said time delay means is developed.

3. A speech-synthesizer timepiece in accordance with claim 2 further comprising:

means for entering time information relating to a specific time interval, said time information including a first time indicative of the beginning of said specific time interval and a second time indicative of the end of said specific time interval;

storage means for storing said first time and said second time and providing output signals indicative of said first time and said second time;

current time indication means for providing a count indicative of the current time and for generating a current time indication output signal in accordance therewith; and means responsive to said output signals from said storage means and to said current time indication output signal for generating a first signal when the current time falls within said time interval, said audible sound warning signal generating means developing said audible sound warning signal when said first signal is generated and when each of the output signals from said time interval counting means is developed.

4. A speech-synthesizer timepiece in accordance with claim 2 further comprising:

means on said timepiece for obtaining an instantaneous indication of said updated time information.

5. A speech-synthesizer timepiece in accordance with claim 4 further comprising:

gate means having an input terminal connected to the output terminal of said time delay means for passing said output signal from said time delay means thereby causing said audible sound signal generating means to develop said audible sound signal.

6. A speech-synthesizer timepiece in accordance with claim 5 wherein said means for obtaining an instantaneous indication of said updated time information comprises a key switch means on said timepiece, said key switch means being connected to another input terminal of said gate means, said audible sound signal generating means developing said audible sound signal in response to activation of said key switch means.

* * * * *